US011236585B2

(12) United States Patent
Tiwari et al.

(10) Patent No.: US 11,236,585 B2
(45) Date of Patent: Feb. 1, 2022

(54) ELECTROMAGNETIC WELLBORE CLEAN OUT TOOL

(71) Applicant: Saudi Arabian Oil Company, Dhahran (SA)

(72) Inventors: Shrikant Tiwari, Dhahran (SA); Opeyemi Adewuya, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 21 days.

(21) Appl. No.: 16/904,395

(22) Filed: Jun. 17, 2020

(65) Prior Publication Data

US 2021/0396097 A1 Dec. 23, 2021

(51) Int. Cl.
*E21B 27/00* (2006.01)
*E21B 37/00* (2006.01)
*E21B 41/00* (2006.01)

(52) U.S. Cl.
CPC ..... *E21B 37/00* (2013.01); *E21B 27/00* (2013.01); *E21B 27/005* (2013.01); *E21B 41/0085* (2013.01)

(58) Field of Classification Search
CPC ..... E21B 27/00; E21B 27/005; E21B 37/00; E21B 41/0085
See application file for complete search history.

(56) References Cited

U.S. PATENT DOCUMENTS 2,657,752 A 11/1953 Ballew et al.
3,441,307 A 4/1969 Farmer
4,828,026 A 5/1989 Nelson
(Continued)

FOREIGN PATENT DOCUMENTS

CN 202539137 U 11/2012
CN 104675346 6/2015
(Continued)

OTHER PUBLICATIONS

Kashem et al., "Study and Comparison on Linear Electromagnetic Shock Absorbers among other Available Intelligent Vibration Dampers", International Journal of Science and Research, vol. 4, Issue 6, pp. 2394-2401, Jun. 2015.
(Continued)

*Primary Examiner* — Brad Harcourt

(74) *Attorney, Agent, or Firm* — Bracewell LLP; Constance G. Rhebergen; Linda L. Morgan

(57) ABSTRACT

Systems and methods for collecting debris in a subterranean well include a wellbore cleanout tool having a tool housing with a tool bore. The wellbore cleanout tool further includes a power source, a wire in electrical communication with the power source, and a core member located within the tool bore. The wire is wound around the core member with a first end and a second end of the wire in electrical connection with a positive terminal and a negative terminal of the power source, respectively. A plurality of magnetic bars are spaced around the core member. A sleeve member is moveable between an uphole position where the sleeve member circumscribes the plurality of magnetic bars, and a downhole position where the sleeve member is located downhole of a portion of the plurality of magnetic bars and can be a collection basket. The wellbore cleanout tool further has a permanent magnet.

12 Claims, 5 Drawing Sheets

(56) References Cited

U.S. PATENT DOCUMENTS

| | | | |
|---|---|---|---|
| 5,675,306 | A | 10/1997 | Diaz |
| 6,439,303 | B1 | 8/2002 | Sorhus et al. |
| 7,190,084 | B2 | 3/2007 | Hall et al. |
| 7,735,547 | B2 | 6/2010 | Telfer |
| 8,689,877 | B2 | 4/2014 | Telfer et al. |
| 10,072,473 | B2 | 9/2018 | Rud |
| 10,480,269 | B2 | 11/2019 | Winkler |
| 2002/0079998 | A1 | 6/2002 | Blange |
| 2005/0274524 | A1 | 12/2005 | Silguero |
| 2010/0243258 | A1 | 9/2010 | Fishbeck et al. |
| 2012/0029702 | A1* | 2/2012 | Tverlid ..... E21B 29/005 700/275 |
| 2015/0330164 | A1 | 11/2015 | Fey et al. |
| 2018/0306005 | A1 | 10/2018 | Costa De Oliveira et al. |
| 2019/0376357 | A1 | 12/2019 | Alssafwany |

FOREIGN PATENT DOCUMENTS

| | | | |
|---|---|---|---|
| CN | 110836101 | A | 2/2020 |
| WO | 2019240835 | A1 | 12/2019 |

OTHER PUBLICATIONS

International Search Report and Written Opinion for PCT Application No. PCT/US2021/037610 dated Sep. 17, 2021.

* cited by examiner

ELECTROMAGNETIC WELLBORE CLEAN OUT TOOL

BACKGROUND OF THE DISCLOSURE

1. Field of the Disclosure

The present disclosure relates to developing subterranean wells, and more particularly to cleaning debris from such subterranean wells.

2. Description of the Related Art

The use of multi-lateral subterranean wells for hydrocarbon development operations can help in exposing longer sections of a reservoir to the subterranean well. Increased reservoir contact can result in increased production of the subterranean well, which in turn reduces the number wells that would need to be drilled for achieving a production target. In a multi-lateral well, a main well bore is constructed in a conventional way by isolating different sections of the well with different sizes of casing. After drilling the main bore, windows can be milled at predetermined depths in the existing casing strings and a lateral bore can be directionally drilled to expose other part of the same reservoir or another reservoir layer.

When drilling multi-lateral subterranean wells the window can be milled through metal casing within the well. The act of milling through metal casing, and the many chemicals that are used as part of drilling fluid result in debris inside the well. This debris needs to be removed before deploying a well completion assembly. Although milling fluid is circulated continuously while milling the window, the circulation of milling fluid does not completely remove the metal debris from the well.

SUMMARY OF THE DISCLOSURE

An improperly cleaned well could jeopardize successful deployment of well completion equipment and can also affect the functional efficiency of well completion tools and equipment. If the well is not thoroughly cleaned before running an upper completion, the suspended metal debris can either damage the critical components of completion strings or can plug the completion string over time, which would require expensive workover operations. As an example, a workover operation could require pulling the completion out of the well and installing a new completion string before the well is put online again to resume production.

Some current systems can use a well bore clean out assembly that is run into the well bore. In current systems multiple clean out runs are required to remove all of the metal debris from the well.

Systems and method of the current application instead provide a wellbore cleanout tool that can remove all of the debris in a single run. The wellbore cleanout tool can include an electromagnet with dense windings surrounding a core and a permanent magnet. As current is passed through the windings, the electromagnet attracts the metal filings. A sleeve that circumscribes the electromagnet can be used as a junk basket. Multiple cleanout tools can be run into the wellbore to more efficiently remove the debris.

In an embodiment of this disclosure, a system for collecting debris in a subterranean well includes a wellbore cleanout tool having a tool housing. The tool housing is an elongated member with a tool bore. The wellbore cleanout tool further includes a power source. A wire is in electrical communication with the power source. A core member is located within the tool bore. The wire is wound around the core member such that a first end of the wire is in electrical connection with a positive terminal of the power source, and a second end of the wire is in electrical connection with a negative terminal of the power source. A plurality of magnetic bars are spaced around the core member. A sleeve member is moveable between an uphole position where the sleeve member circumscribes the plurality of magnetic bars, and a downhole position where the sleeve member is located downhole of a portion of the plurality of magnetic bars and is a junk basket. The wellbore cleanout tool further includes a permanent magnet.

In alternate embodiments, the wellbore cleanout tool can be delivered into the subterranean well with a delivery string. The power source can include a turbine impeller located within the tool bore and a generator in mechanical connection with the turbine impeller. The positive terminal and the negative terminal can be part of the generator. Alternately, the power source can be part of the delivery string.

In other alternate embodiments, each of the magnetic bars can be elongated magnets positioned with an axial orientation within the tool bore. A shroud can house the plurality of magnetic bars. An inlet of the shroud can be oriented to direct fluid within the subterranean well into the shroud and over the plurality of magnetic bars.

In an alternate embodiment of this disclosure, a method for collecting debris in a subterranean well includes delivering a wellbore cleanout tool into the subterranean well. The wellbore cleanout tool has a tool housing that is an elongated member with a tool bore. A current is delivered through a wire with a power source. The wire is wound around a core member to form an electromagnet. A first end of the wire is in electrical connection with a positive terminal of the power source, and a second end of the wire is in electrical connection with a negative terminal of the power source. The core member is located within the tool bore. A plurality of magnetic bars spaced around the core member are amplified with an electromagnetic field of the electromagnet. A sleeve member is moved between a downhole position where the sleeve member is located downhole of the plurality of magnetic bars and an uphole position where the sleeve member circumscribes the plurality of magnetic bars. A flow of wellbore fluid is directed past the plurality of magnetic bars. Debris within the wellbore fluid is attracted by the plurality of magnetic bars. The flow of wellbore fluid is directed past a permanent magnet. Debris within the wellbore fluid is attracted by the permanent magnet. Debris within the wellbore fluid is collected in the sleeve member that is in the downhole position.

In alternate embodiments, delivering the wellbore cleanout tool into the subterranean well can include delivering the wellbore cleanout tool into the subterranean well with a delivery string. The power source can include a turbine impeller located within the tool bore and a generator in mechanical connection with the turbine impeller. Delivery of the current through the wire with the power source can include rotating the turbine impeller. Alternately, the power source can be part of the delivery string.

In other alternate embodiments, each of the magnetic bars can be elongated magnets and the method can further include positioning each of the magnetic bars in an axial orientation within the tool bore. The wellbore cleanout tool can further include a shroud with an inlet. The shroud can house the plurality of magnetic bars. The method can further include directing the flow of wellbore fluid into the shroud and over the plurality of magnetic bars.

BRIEF DESCRIPTION OF THE DRAWINGS

So that the manner in which the features, aspects and advantages of the embodiments of this disclosure, as well as others that will become apparent, are attained and can be understood in detail, a more particular description of the disclosure may be had by reference to the embodiments thereof that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION

The disclosure refers to particular features, including process or method steps. Those of skill in the art understand that the disclosure is not limited to or by the description of embodiments given in the specification. The subject matter of this disclosure is not restricted except only in the spirit of the specification and appended Claims.

Those of skill in the art also understand that the terminology used for describing particular embodiments does not limit the scope or breadth of the embodiments of the disclosure. In interpreting the specification and appended Claims, all terms should be interpreted in the broadest possible manner consistent with the context of each term. All technical and scientific terms used in the specification and appended Claims have the same meaning as commonly understood by one of ordinary skill in the art to which this disclosure belongs unless defined otherwise.

As used in the Specification and appended Claims, the singular forms "a", "an", and "the" include plural references unless the context clearly indicates otherwise.

As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Where a range of values is provided in the Specification or in the appended Claims, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the specification and appended Claims to a method comprising two or more defined steps, the defined steps can be carried out in any order or simultaneously except where the context excludes that possibility.

Figure 1:
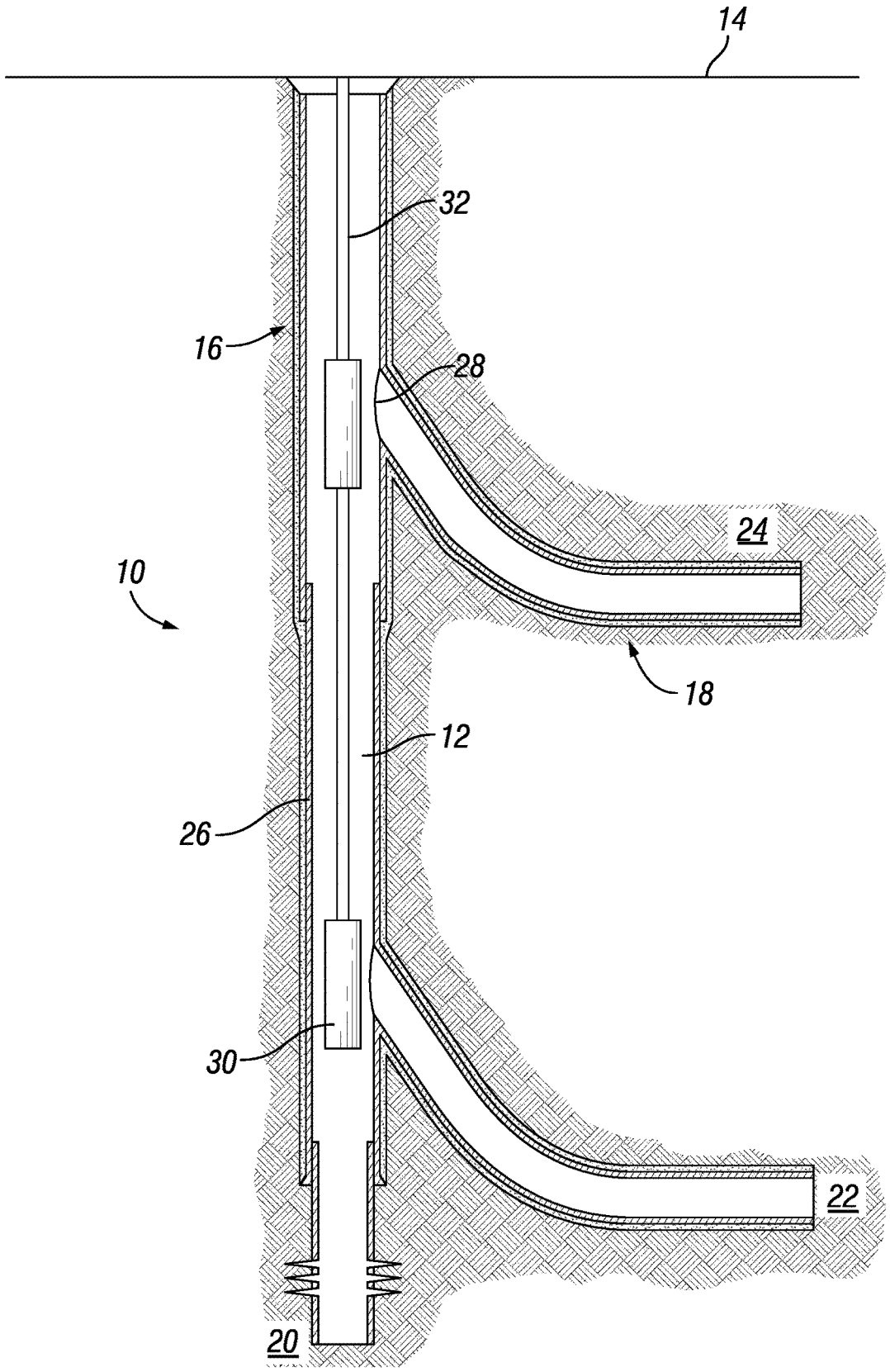
FIG. 1 is a section view of a subterranean well including a wellbore cleanout tool, in accordance with an embodiment of this disclosure.

Looking at FIG. 1, subterranean well 10 can have wellbore 12 that extends to an earth's surface 14. Wellbore 12 can be drilled from surface 14 and into and through various formation zones of subterranean formations. Subterranean well 10 can be an offshore well or a land based well and can be used for producing hydrocarbons from subterranean hydrocarbon reservoirs. Alternately, subterranean well 10 can be a water well, injection well, disposal well, test well, observation well, or other known type of subterranean well.

Wellbore 12 can include a generally vertical section 16, relative to surface 14. Wellbore 12 can also include a sidetrack, horizontal, multilateral, or deviated section 18 that is angled relative to surface 14. In certain embodiments deviated section 18 can be generally horizontal relative to surface 14. In other embodiments, deviated section 18 can be at any inclination, other than zero, relative to vertical section 16.

Vertical section 16 can located within the target production zone 20 and will allow for hydrocarbons within production zone 20 to be produced to the surface. Alternately, vertical section 16 can be used to observe conditions within various formation zones associated with subterranean well 10. Each deviated section 18 may be located within the lateral target production zones 22 and 24 and will allow for hydrocarbons within such lateral production zones 22 and 24 to be produced to the surface. Alternately, any or all of the deviated sections 18 can be used for observation or injection.

When drilling subterranean well 10, casing 26 can be set at predetermined depth and cemented to isolate the formations drilled to that depth. Casing 26 ensures that continued drilling of wellbore 12 below casing 26 will not be impacted by the characteristics of any formations drilled in previous part of subterranean well 10, which are isolated by casing 26. Vertical section 16 of subterranean well 10 can be drilled in a traditional matter.

In order to drill deviated section 18, a whipstock can be installed under the sidetrack point 28 to guide the drilling of deviated section 18. Sidetrack point 28 is the junction where deviated section 18 meets vertical section 16. Deviated section 18 can then be sidetracked by milling a window through metal casing 26 to the lateral production zone 24 away from the vertical section 16. The deviated section 18 can also be cased and cemented. Alternatively, other know means can be used to drill deviated section 18 of subterranean well 10. The process of drilling through metal casing 26 to create deviated section 18 and the chemicals used as part of the drilling process will produce debris inside wellbore 12.

Wellbore cleanout tool 30 can be used to collect and remove the debris from subterranean well 10. Wellbore cleanout tool 30 can be delivered into wellbore 12 of subterranean well 10 with delivery string 32. Delivery string 32 can be, for example, a wireline, e-coiled tubing, or drill pipe. The uphole (box) and downhole (pin) end of wellbore cleanout tool will have threaded connections 54 (FIGS. 2-4)

or an alternate connection assembly so that one or more wellbore cleanout tools can be connected in line with delivery string 32.

In the example embodiment of FIG. 1, two wellbore cleanout tools 30 are shown secured to delivery string 32. In alternate embodiments, one wellbore cleanout tool 30 can be used. In other alternate embodiments, more than two wellbore cleanout tools can be included. The number of wellbore cleanout tools 30 used, as well as the positioning of the wellbore cleanout tools 30 along delivery string 32 can be selected based on the expected amounts and locations of debris that will need to be removed. By including multiple wellbore cleanout tools 30 on delivery string 32, debris from a longer section of subterranean well 10 can be removed in a single run.

Figure 2:
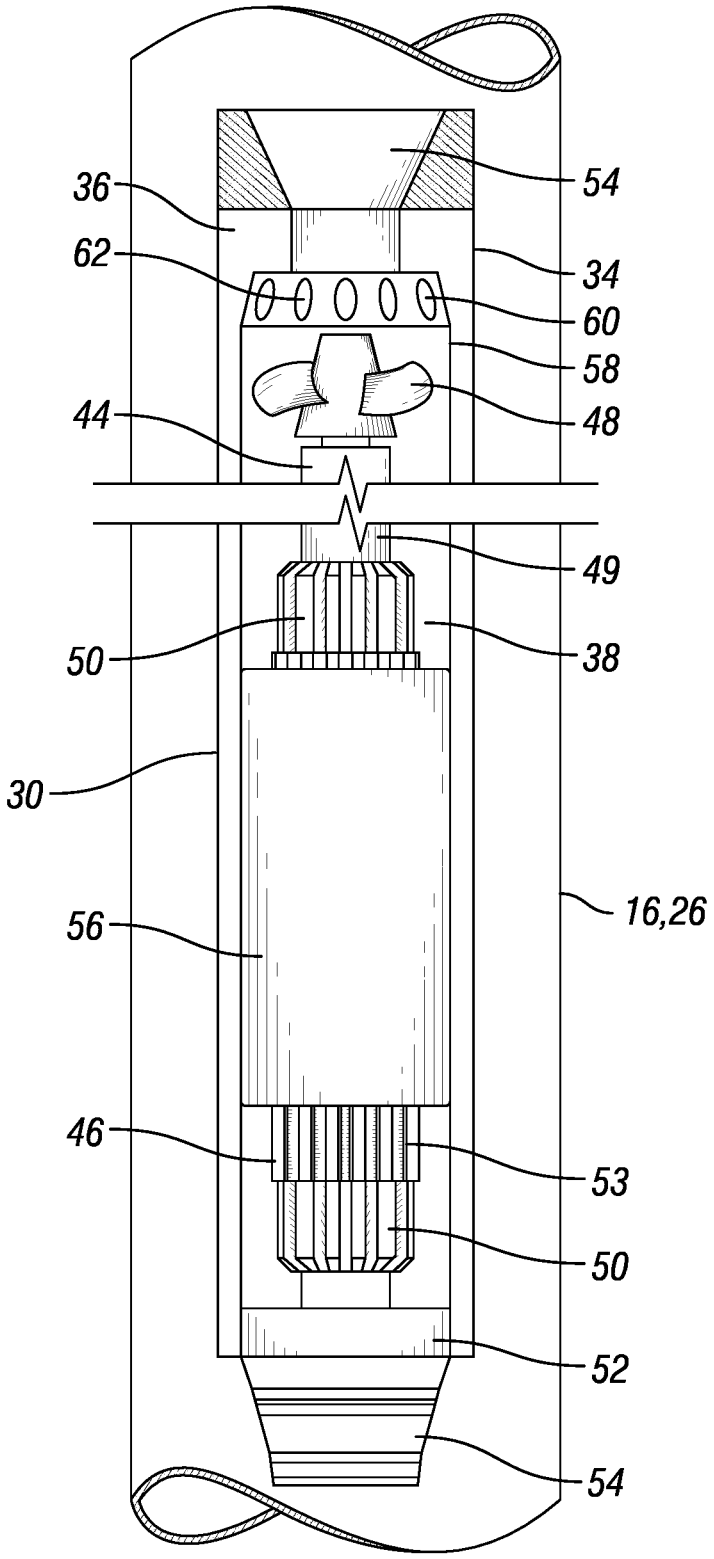
FIG. 2 is a section view of a wellbore cleanout tool, in accordance with an embodiment of this disclosure, shown with the sleeve in an uphole position.
Figure 3:
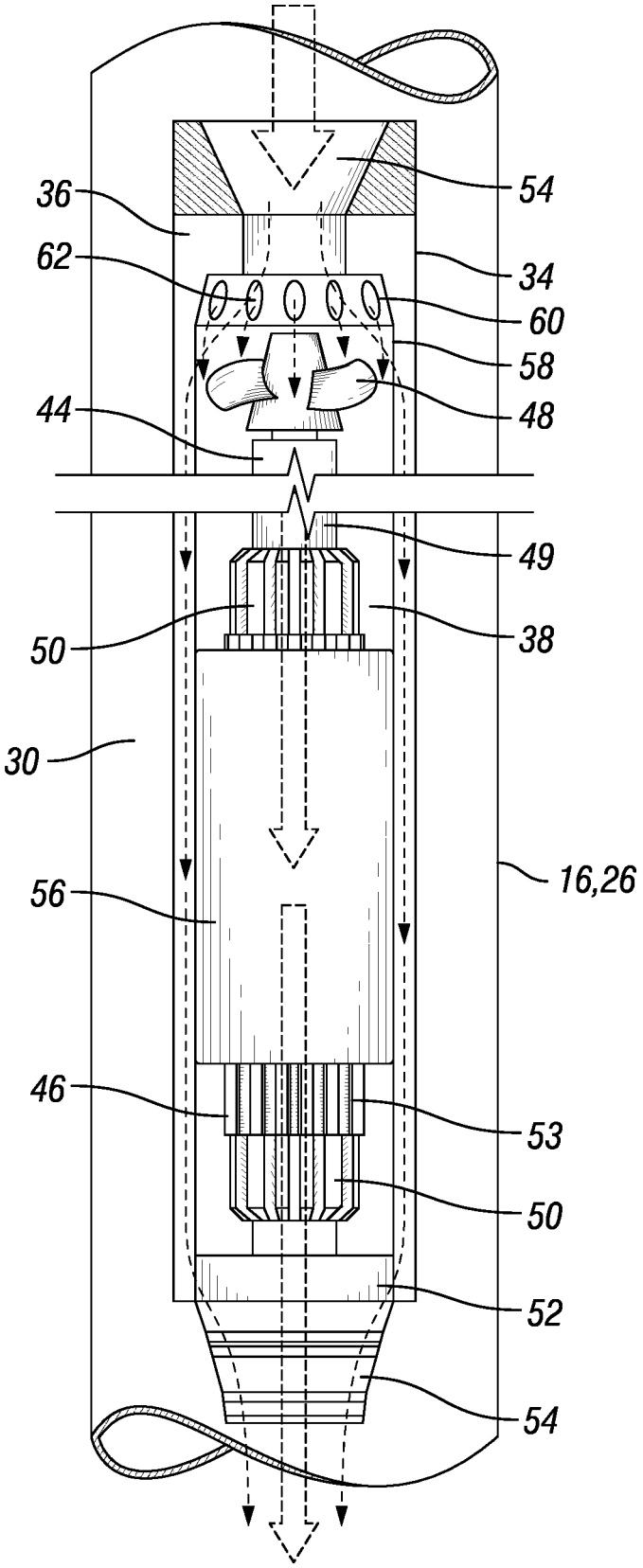
FIG. 3 is a section view of a wellbore cleanout tool, in accordance with an embodiment of this disclosure, shown with the sleeve in an uphole position, showing a flow of fluid through the wellbore cleanout tool.
Figure 4:
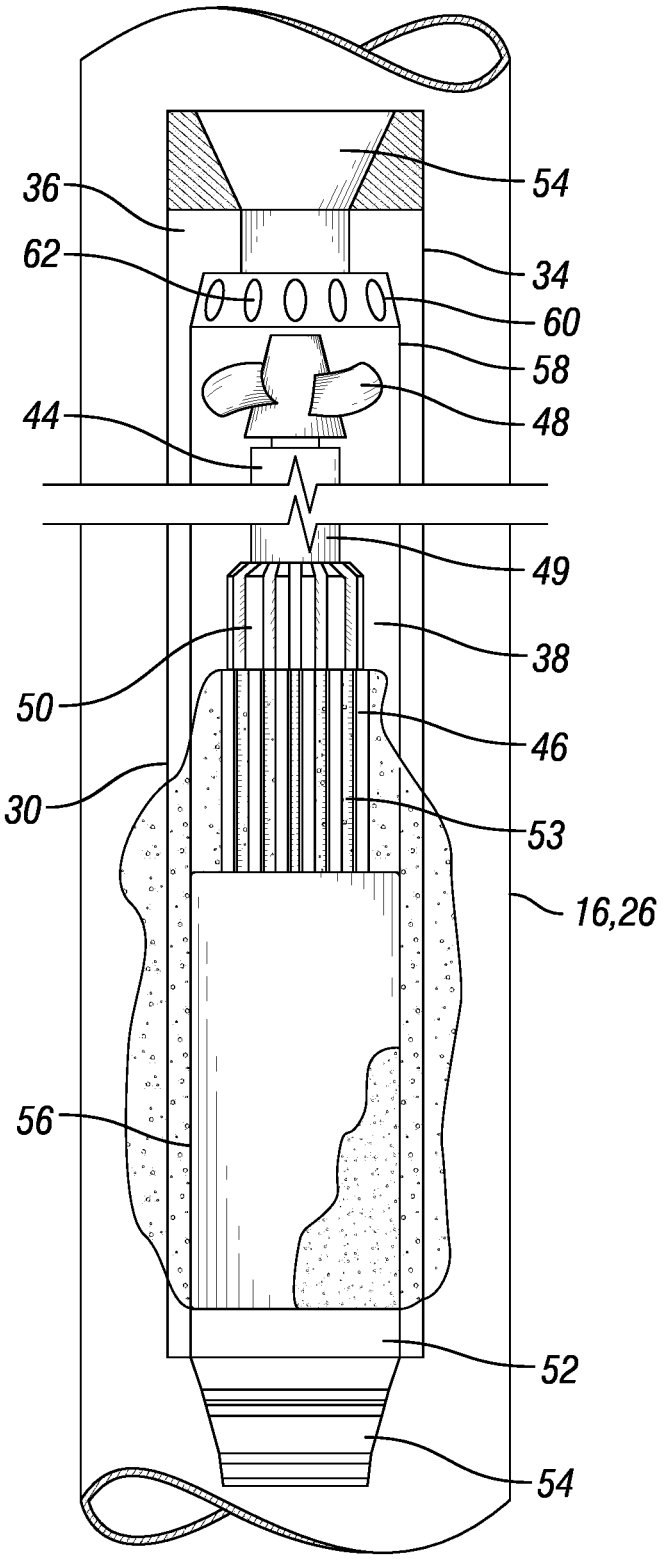
FIG. 4 is a section view of the wellbore cleanout tool, in accordance with an embodiment of this disclosure, shown with the sleeve in a downhole position, showing the debris attracted to the tool housing and trapped by the sleeve.
Figure 5:
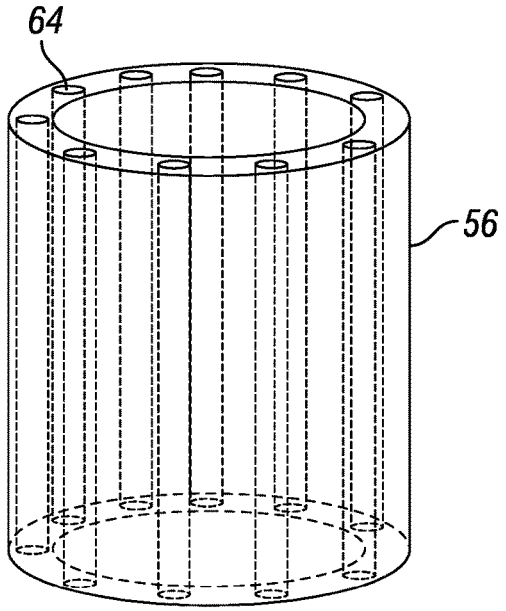
FIG. 5 is a close up view of the sleeve, in accordance with an embodiment of this disclosure, showing the mesh screen body and axial flow passages.

Looking at FIGS. 2-3, wellbore cleanout tool 30 can include tool housing 34. Tool housing 34 is an elongated member with tool bore 36. Tool bore 36 is a central open bore that extends from an uphole end of tool housing 34 to a downhole end of tool housing 34.

Electromagnet 38 is located within tool bore 36. Looking at FIG. 4, electromagnet 38 includes core member 40. Core member 40 can be formed, for example, of a ferromagnetic material. In alternate embodiments, core member 40 can be formed of, for example, an iron, such as a 99.95% purity soft iron, a permalloy, a silicon steel, a ferrocerramic, an amorphous steel, a neodymium (N52), or a neodymium (N42SH), which may be particularly useful for high temperature applications. Core member 40 can be an elongated member. In embodiments, core member 40 can have a circular cross section or can have a cross section with another geometrical shape.

Figure 6:
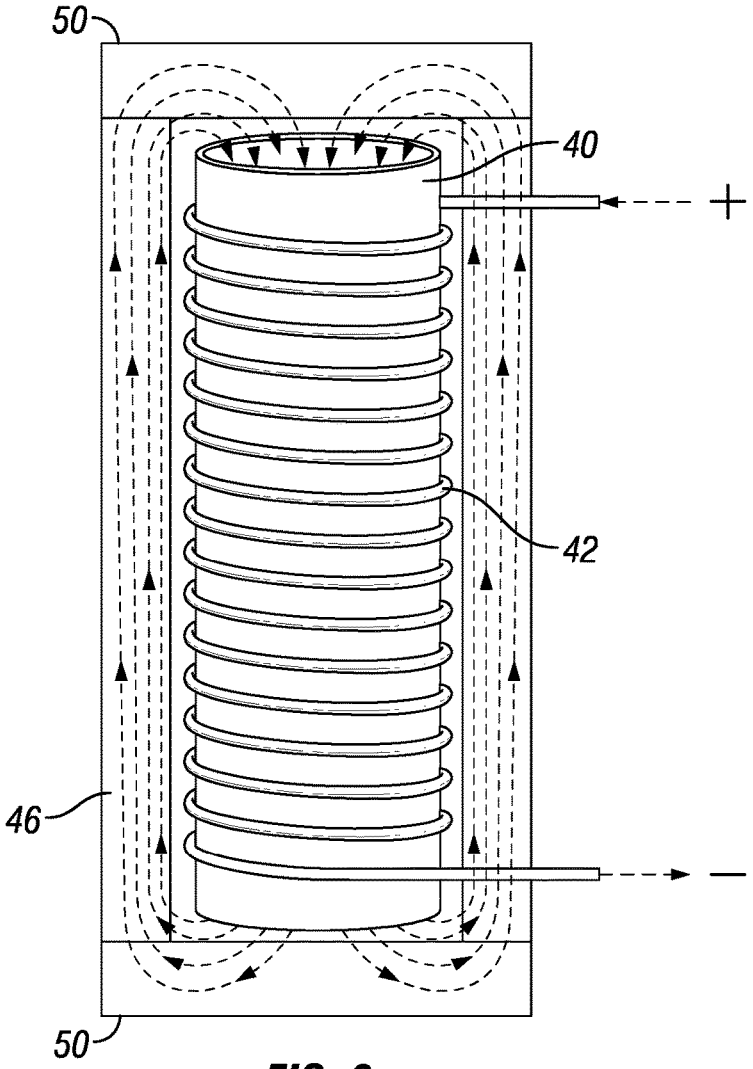
FIG. 6 is a schematic partial section view of an electromagnet of a wellbore cleanout tool, in accordance with an embodiment of this disclosure.

Wire 42 is wound around core member 40. Wire 42 can be formed, for example, of a standard NEMA HP3 TYPE E AWG 24 wire, or a proprietary PTFE-coated copper wire. Wire 42 is in electrical communication with power source 44 (FIG. 6). Wire 42 is wound around core member 40. A first end of wire 42 is in electrical connection with a positive terminal of power source 44. A second end of wire 42 is in electrical connection with a negative terminal of power source 44.

The strength of an electromagnet depends on quality of core material, windings per inch and current supplied to the windings. The number of windings per inch of wire 42 around core member 40 is dependent on variables such as the core material, the magnetic permeability of the core material, the wire used, and the amount of magnetic saturation at maximum field strength achievable. The windings per inch can be determined by design parameters established to increase the permanent state magnetic flux strength of the selected core materials by a multiple of 4.4. In example embodiments of this disclosure, the current provided to wire 42 can be in a range of 750 to 900 ampere. By varying the materials used to form core member 40, the number of windings of wire 42 per inch around core member 40, and current supplied to wire 42, the strength of electromagnet 38 can be adjusted to suit the conditions of a particular subterranean well 10.

A number of magnetic bars 46 are spaced around core member 40. Magnetic bars 46 are high strength magnetic bars. In embodiments of this disclosure, a high strength magnetic bar is considered to have a strength in a range of 13,200-14,800 Gauss. Magnetic bars 46 are elongated members that are arranged and aligned in such a way that the magnetic fields formed by electromagnet 38 are reinforcing and strengthening magnetic bars 46 to achieve electromagnetic-amplification beyond the threshold or permanent magnetism or magnetic state of core member 40. Magnetic bars 46 are positioned so that the long axis of each magnetic bar 46 is arranged in an axial orientation within tool bore 36. That is, the longitudinal axis of magnetic bar 46 is generally parallel to a central axis of tool bore 36.

Magnetic bars 46 act in a similar manner to adding an iron pipe or iron cladding to an electromagnet, which is commonly known as an iron-clad electromagnet. As shown in FIG. 6, the flux return path is at least in part through magnetic bars 46. The addition of magnetic bars 46 increases the total magnetic flux. In order to maximize the benefit of the addition of magnetic bars 46, the gap between the inner diameter surfaces of magnetic bars 46 and the outer diameter of wire 42 should be minimized. Any air gap between the inner diameter surfaces of magnetic bars 46 and the outer diameter of wire 42 will increase the magnetic reluctance along the magnetic path. In an embodiment, the inner diameter surfaces of magnetic bars 46 can be in contact with wire 42.

Looking at FIGS. 2-5, wellbore cleanout tool 30 further includes shroud 58. Shroud 58 houses magnetic bars 46 within tool housing 34. Shroud 58 has a stepped or angled reduction in internal diameter at an uphole end of shroud 58 to form an inlet 60. Inlet 60 is oriented to direct fluid within subterranean well 10 into shroud 58 and over the plurality of magnetic bars 46. Inlet 60 includes openings 62 that provides a fluid flow path into shroud 58. In the example embodiment of FIGS. 2-3, inlet 60 directs the flow of fluid towards turbine impeller 48 so that power source 44 produces an electric current.

Looking at FIGS. 2-3, in an example embodiment, power source 44 includes an axial-flow turbine power unit having turbine impeller 48, an alternator or a generator 49 comprising magnets and windings. Turbine impeller 48 and the alternator or the generator 49 are located within tool bore 36. Turbine impeller 48 is mechanically connected to the alternator or generator 49. Fluid flow over turbine impeller 48, can cause turbine impeller 48 to rotate so that the alternator or generator 49 can produce an electric current. When fluid flow over turbine impeller 48 stops, power source 44 will cease to produce electric current.

As an example, if an alternator is used to produce the electric current, the alternator can include permanent magnets that are embedded in an armature. The armature can be rotated by rotation of turbine impeller 48. The armature can rotate within static windings of the alternator. As the magnets rotate relative to the windings a magnetic field is produced, inducing an alternating voltage in the windings. The windings can be arranged so that the alternator produces the electric current required to power electromagnet 38.

In the example embodiment of FIGS. 2-3, the generator 49 can include the positive terminal for electrical connection with the first end of wire 42, and the negative terminal for the second end of wire 42. In alternate embodiments power source 44 can be part of delivery string 32. For example, power source 44 can be in the form of a current passing through an e-line, wireline, digital slick line, wired pipes, coil tubing or other known systems for delivering a current downhole.

The electric current provided by power source 44 can be used to deliver a current to wire 42 to generate ultra-high magnetic fields with electromagnet 38. In embodiments of this disclosure, an ultra-high magnetic field is a magnetic field having a magnetic strength greater than 14,800 Gauss. The ultra-high magnetic fields amplify the magnetic field strength and saturation of magnetic bars 46. Magnetic bars 46 can be exposed to fluid passing through wellbore cleanout tool 30 in a downhole direction, as well as fluid that is downhole of wellbore cleanout tool 30 and returning to the surface in an uphole direction, depending on the direction of flow of the drilling fluid.

Looking at FIGS. 2-4, wellbore cleanout tool 30 further includes permanent magnet 53. Permanent magnet 53 is a separate magnet from electromagnet 38. A series of permanent magnets 53 can be juxtaposed longitudinally with magnetic bars 46, as shown in the embodiment of FIGS. 2-4. In such an embodiment, permanent magnets 52 and magnetic bars 46 are capped with end caps 50 to ensure that the magnetic field lines are directed and guided into the bars to reinforce the strength of the magnetic flux. Permanent magnet 53 can alternately be located within tool housing 34 downhole of magnetic bars 46.

Permanent magnet 53 can attract debris from within wellbore 12. As an example, when electromagnet 38 is turned off, debris that was previously attracted to magnetic bars 46 can be drawn towards permanent magnet 53. Looking at FIG. 4, permanent magnet 53 can attract debris that is exterior of tool housing 34 and retain such debris with wellbore cleanout tool 30 as wellbore cleanout tool 30 is returned to the surface.

Looking at FIGS. 2-5, wellbore cleanout tool 30 includes sleeve member 56. Sleeve member 56 can be a cylindrical device located within tool housing 34. Looking at FIG. 5, sleeve member 56 can have a ring shaped cross section. Flow passages 64 can extend axially through a sidewall of sleeve member 56. Flow passages minimize the generation of high pressure drops within the tool. Flow passages 64 allow for an amount of metering action as the drilling fluid flow flows through the central bore of the tool at a high flow rate.

Sleeve member 56 can be formed of a mesh material or can be a solid ring member. In certain embodiments, when first running wellbore cleanout tool 30 into a subterranean well where large sized metal debris is expected, sleeve member 56 can be formed of a mesh material. If running wellbore cleanout tool 30 into subterranean wells where smaller sized metal debris is expected, a sleeve member 56 can be a solid ring shaped member with flow passages 64.

Sleeve member 56 can be sized so that the inner diameter of sleeve member 56 is larger than the outer diameter of magnetic bars 46. This will result in an annular space that is defined between the inner diameter surface of sleeve member 56 and the outer diameter surface of magnetic bars 46. The outer diameter of sleeve member 56 can be flush with the inner diameter of tool housing 34 so that tool housing 34 can guide sleeve member 56 as sleeve member 56 moves between an uphole position and a downhole position.

Sleeve member 56 is moveable between an uphole position (FIGS. 2-3) and a downhole position (FIG. 4). Looking at FIG. 3, when drilling fluid is pumped downhole or in a circulation pattern through wellbore cleanout tool 30, the pressure drop across wellbore cleanout tool 30 as the drilling fluid exits a downhole end of wellbore cleanout tool 30 creates a pump-open force. The pump-open force transmits an upwards lift force on sleeve member 56, lifting sleeve member 56 in an uphole direction off of base 52. In the uphole position, sleeve member 56 circumscribes magnetic bars 46.

When no drilling fluid is being pumped down through wellbore cleanout tool, there is no pump-open force and sleeve member 56 will fall to the downhole position. In the downhole position, sleeve member 56 is located downhole of a least a portion of magnetic bars 46, as shown in FIG. 4. When sleeve member 56 is located in the downhole position, a downhole end of sleeve member 56 contacts base 52. Base 52 is a ring seal positioned at a downhole end of tool housing 34. When sleeve member 56 is located in the downhole position, base 52 sealingly engages the downhole end of sleeve member 56. Base 52 is sized and shaped so that when a downhole end of sleeve member 56 lands on base 52 debris that is located within sleeve member 56 is prevented from exiting out of the downhole end of wellbore cleanout tool 30. The weight of the sleeve member 56, and hydrostatic force of the fluid in tool bore 36 and the debris captured within tool bore 36 can hold sleeve member 56 down on base 52.

When sleeve member 56 is located in the downhole position, sleeve member 56 can be a collection basket. Sleeve member 56 can have a cylindrical shape, as shown, or can alternately have an inverted cone or skirt shape with a smaller cross sectional dimension at a downhole end of sleeve member 56 compared to a cross sectional dimension of sleeve member 56 at an uphole end of sleeve member 56. In the downhole position, sleeve member 56 can act as a junk basket and can collect debris. Debris collected in sleeve member 56 can be taken to the surface within sleeve member 56 when wellbore cleanout tool 30 is returned to the surface.

In addition, when fluid flow through wellbore cleanout tool 30 ceases, and sleeve member 56 moves to the downhole position of FIG. 4, electromagnet 38 is off. In the downhole position, sleeve member 56 enshrouds at least a portion of magnetic bars 46 and can collects metal debris in excess of what is trapped by magnetic bars 46.

In an example of operation, after generating debris in subterranean well 10, such as by milling through metal casing, one or more wellbore cleanout tools 30 can be secured in line with delivery string 32. Delivery string 32 can be used to deliver wellbore cleanout tools 30 into subterranean well 10.

A current is supplies through wire 42 of electromagnet 38, amplifying magnetic bars 46 that are spaced around electromagnet 38. As an example, electromagnet 38 can increase the permanent state magnetic flux strength of magnetic bars 46 by a factor of 4.4 times the original magnetic flux of magnetic bars 46.

Magnetic bars 46 attract debris within a flow of fluid of subterranean well 10. By moving wellbore cleanout tool 30 uphole and downhole within subterranean well 10, debris that is suspended within a section of wellbore 12 can be collected by wellbore cleanout tool 30.

When the flow of fluid through wellbore cleanout tool 30 is stopped, sleeve member 56 can move to a downhole position and act as a junk basket, collecting debris that can be returned to the surface as wellbore cleanout tool is pulled from wellbore 12. Permanent magnet 53 can further attract and retain debris that can be returned to the surface as wellbore cleanout tool is pulled from wellbore 12.

Embodiments of this disclosure therefore provide systems and methods for capturing and removing all debris, including metallic shavings and metal pieces generated as part of milling process or as a result of casing erosion. Systems and methods of this disclosure capture and remove the debris in a single trip into the well. By managing the magnet strength and the number of wellbore cleanout tools that are connected in the delivery string, the efficiency of debris removal can be optimized.

Embodiments of this disclosure, therefore, are well adapted to carry out the objects and attain the ends and advantages mentioned, as well as others that are inherent. While embodiments of the disclosure has been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A system for collecting debris in a subterranean well, the system including:

a wellbore cleanout tool having:

a tool housing, the tool housing being an elongated member with a tool bore;

a power source;

a wire in electrical communication with the power source;

a core member located within the tool bore, where the wire is wound around the core member such that a first end of the wire is in electrical connection with a positive terminal of the power source, and a second end of the wire is in electrical connection with a negative terminal of the power source;

a plurality of magnetic bars spaced around the core member;

a sleeve member moveable between an uphole position where the sleeve member circumscribes the plurality of magnetic bars, and a downhole position where the sleeve member is located downhole of a portion of the plurality of magnetic bars and is a collection basket; and a permanent magnet.

2. The system of claim 1, where the power source includes a turbine impeller located within the tool bore and a generator in mechanical connection with the turbine impeller, where the positive terminal and the negative terminal are part of the generator.

3. The system of claim 1, where the wellbore cleanout tool is delivered into the subterranean well with a delivery string.

4. The system of claim 3, where the power source is part of the delivery string.

5. The system of claim 1, where each of the magnetic bars are elongated magnets positioned with an axial orientation within the tool bore.

6. The system of claim 1, further including a shroud that houses the plurality of magnetic bars and an inlet oriented to direct fluid within the subterranean well into the shroud and over the plurality of magnetic bars.

7. A method for collecting debris in a subterranean well, the method including:

delivering a wellbore cleanout tool into the subterranean well, the wellbore cleanout tool having a tool housing that is an elongated member with a tool bore;

delivering a current through a wire with a power source, where the wire is wound around a core member to form an electromagnet, such that a first end of the wire is in electrical connection with a positive terminal of the power source, and a second end of the wire is in electrical connection with a negative terminal of the power source, and where the core member is located within the tool bore;

amplifying a plurality of magnetic bars spaced around the core member with an electromagnetic field of the electromagnet;

moving a sleeve member between a downhole position where the sleeve member is located downhole of at least a portion the plurality of magnetic bars and an uphole position where the sleeve member circumscribes the plurality of magnetic bars;

directing a flow of wellbore fluid past the plurality of magnetic bars and attracting debris within the wellbore fluid with the plurality of magnetic bars;

directing the flow of wellbore fluid past the a permanent magnet and attracting debris within the wellbore fluid with the permanent magnet; and collecting debris within the wellbore fluid in the sleeve member that is in the downhole position.

8. The method of claim 7, where the power source includes a turbine impeller located within the tool bore and a generator in mechanical connection with the turbine impeller, and where delivering the current through the wire with the power source includes rotating the turbine impeller.

9. The method of claim 7, where delivering the wellbore cleanout tool into the subterranean well includes delivering the wellbore cleanout tool into the subterranean well with a delivery string.

10. The method of claim 9, where the power source is part of the delivery string.

11. The method of claim 7, where each of the magnetic bars are elongated magnets and the method further includes positioning each of the magnetic bars in an axial orientation within the tool bore.

12. The method of claim 7, further including a shroud with an inlet, where the shroud houses the plurality of magnetic bars, and where the method further includes directing the flow of wellbore fluid into the shroud and over the plurality of magnetic bars.

* * * * *